US012232637B2

(12) United States Patent
Burciaga

(10) Patent No.: US 12,232,637 B2
(45) Date of Patent: Feb. 25, 2025

(54) FAST FRAME

(71) Applicant: Louis Burciaga, Houston, TX (US)

(72) Inventor: Louis Burciaga, Houston, TX (US)

( * ) Notice: Subject to any disclaimer, the term of this patent is extended or adjusted under 35 U.S.C. 154(b) by 0 days.

(21) Appl. No.: 17/688,895

(22) Filed: Mar. 7, 2022

(65) Prior Publication Data

US 2022/0279944 A1 Sep. 8, 2022

Related U.S. Application Data

(60) Provisional application No. 63/157,809, filed on Mar. 7, 2021.

(51) Int. Cl.
*A47G 1/06* (2006.01)
*A47G 1/16* (2006.01)

(52) U.S. Cl.
CPC ..... *A47G 1/1606* (2013.01); *A47G 1/0616* (2013.01); *A47G 2001/0666* (2013.01)

(58) Field of Classification Search
CPC ..... A47G 1/1606; A47G 1/0616; A47G 2001/0666
USPC ..... 40/740
See application file for complete search history.

(56) References Cited

U.S. PATENT DOCUMENTS 1,573,264 A * 2/1926 Mankameyer ..... G09F 15/0012 40/611.03
3,918,187 A * 11/1975 Vogele ..... G09F 7/02 40/760
4,258,488 A * 3/1981 Schienbein ..... A47G 1/06 40/760
5,415,296 A * 5/1995 Wright ..... G11B 33/0483 211/40
5,485,926 A * 1/1996 Kundert ..... G11B 33/0483 312/9.9
5,603,415 A * 2/1997 Balnis, Jr. ..... G11B 33/0483 211/40
8,667,721 B2 * 3/2014 Heeps ..... A47F 7/142 40/781
9,215,941 B1 * 12/2015 Kressin ..... G11B 33/0427
2009/0119964 A1 * 5/2009 Snider ..... B42D 1/08 40/745

FOREIGN PATENT DOCUMENTS

DE 202014004498 U1 * 8/2014 ..... A47B 81/067
WO WO-9736299 A1 * 10/1997 ..... G11B 33/0416

* cited by examiner

*Primary Examiner* — Cassandra Davis
(74) *Attorney, Agent, or Firm* — Delphine James

(57) ABSTRACT

An ornamental frame is provided having a front frame attached to a back support plate. The back support plate comprises a front side that forms a display for receiving the ornamental album thereon and a backside having mounting fasteners for hanging the ornamental frame on the wall. The front frame in one embodiment has a rectangular shape for receiving the display album therein with a finger notch located on the bottom edge of the front frame for removing the display album from the ornamental frame. The frame further comprises an ornamental sleeve that encapsulates the ornamental frame.

13 Claims, 8 Drawing Sheets exploded

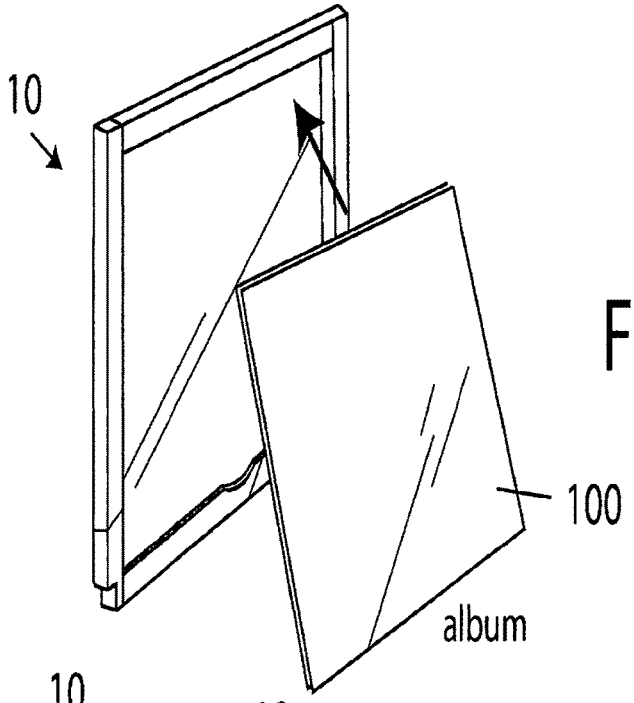
Fig. 3
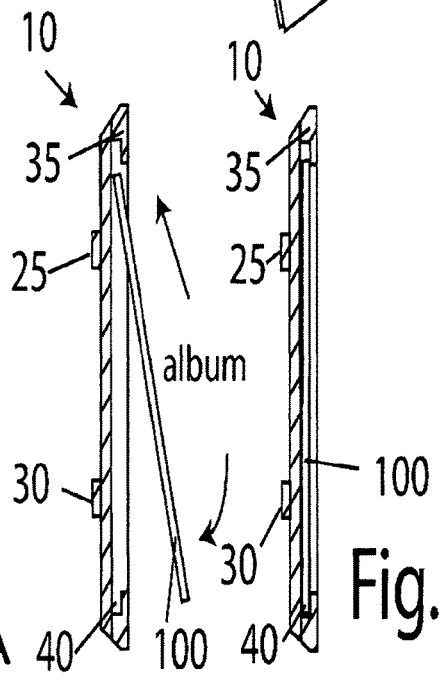
Fig. 4
Fig. 4A
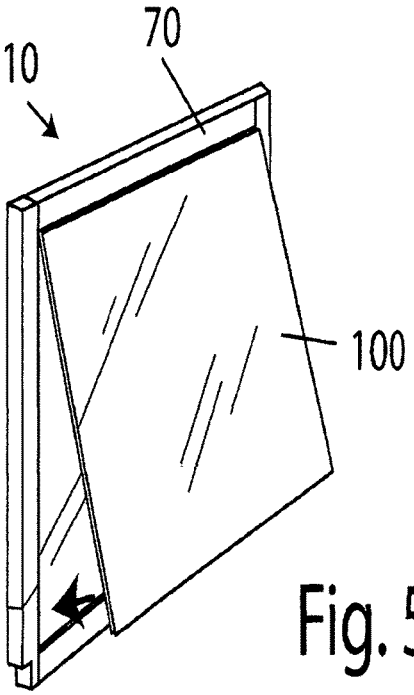
Fig. 5 exploded

FAST FRAME

BACKGROUND OF THE INVENTION

The present invention relates to an ornamental frame, and more particularly, to a frame within which bound albums or other types of memorabilia can be both stored and displayed.

People enjoy collecting, displaying, and viewing a variety of memorabilia such as bound albums, photographs, cards, diplomas, certificates, credentials, and other sentimental items. An LP Album means long playing album and is a conventional 12 inch LP vinyl record.

An LP album can be 10 or 12 inches in diameter and was introduced around 1948. Thus, LP Albums have become collector albums around the world. This patent provides a novel design for an ornamental frame specifically design to contain a conventional LP Album as well as a variety of memorabilia.

SUMMARY OF THE INVENTION

In an exemplary embodiment, an ornamental frame is provided that has no moving parts and is dimensionally compatible with a bound album that can be inserted into the frame such that the cover of the album, when seated within the frame, can resemble an image that has been matted and framed.

In an exemplary embodiment, the ornamental frame comprises a front frame and a back-mounting plate that are attached together. A finger notch along the bottom edge of the front frame can provide a means for conveniently removing the album from the frame. Inner guiding grooves along the top and bottom inner periphery surfaces of the inner frame can engage the storage container of the album or other memorabilia when it is being inserted into the frame.

In an exemplary embodiment of the present invention, the ornamental frame further includes a sleeve cover that encapsulated the ornamental frame.

The above and other objects, features and advantages of the present invention should become even more readily apparent to those skilled in the art upon a read in of the following detailed description in conjunction with the drawings wherein there is shown and described illustrative embodiments of the invention.

BRIEF DESCRIPTION OF DRAWINGS

These and other details of the present invention will be described in connection with the accompanying drawings, which are not furnished only by way of illustration and not in limitation of the invention.

FIG. 3 is a cross sectional view of the ornamental frame with the storage container outside of the frame.

FIG. 4 is a cross sectional view of the album storage container inside of the ornamental frame.

FIG. 4A is a cross sectional view of the album storage outside of the ornamental frame.

FIG. 5 is a perspective view showing the album storage container in the ornamental frame.

DETAILED DESCRIPTION OF THE INVENTION

Figures 1, 1A:
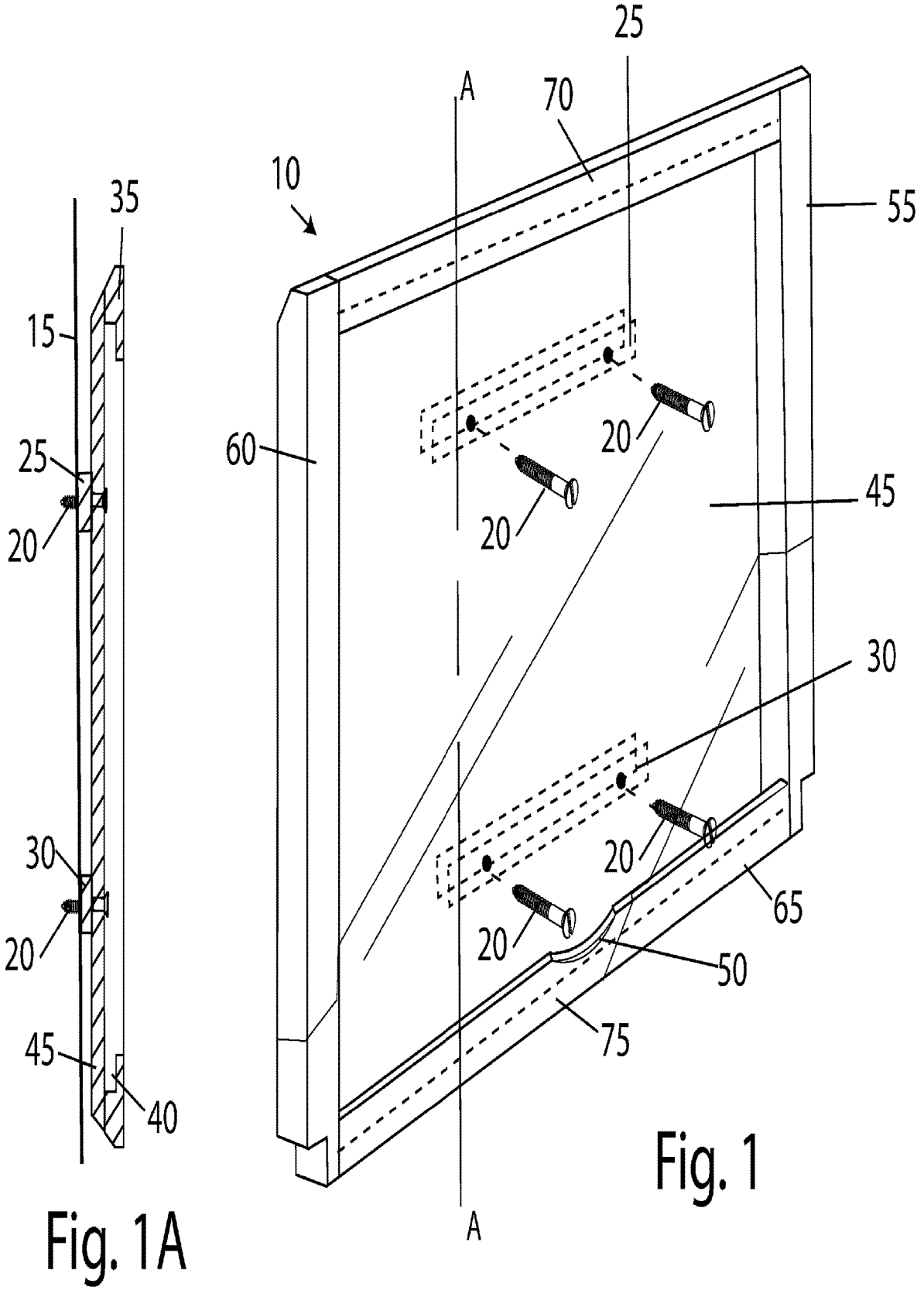
FIG. 1 is a perspective view of present invention, an ornamental frame.
FIG. 1*a* is a cross sectional view of the ornamental frame.
Figure 2:
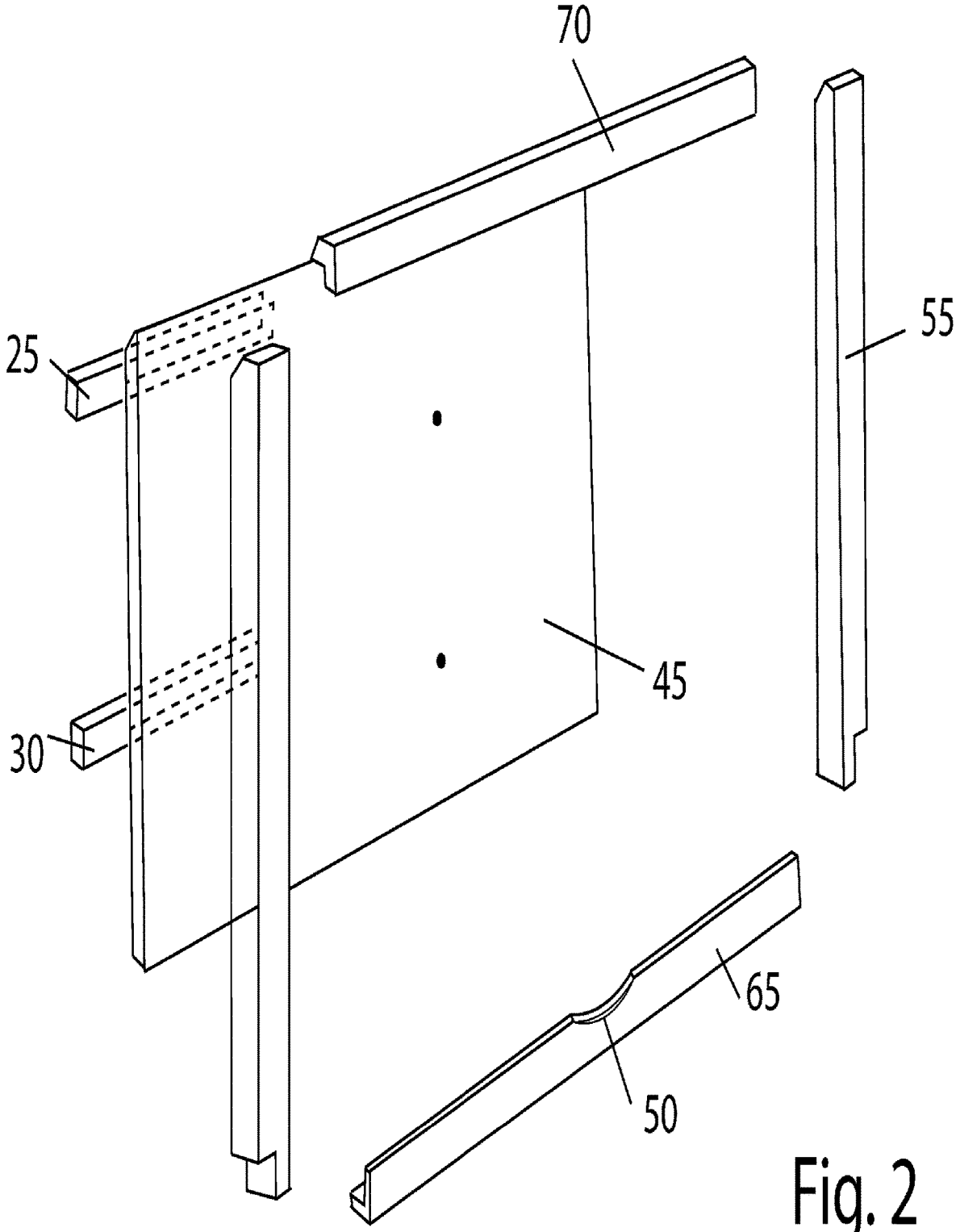
FIG. 2 is an exploded view of the ornamental frame. perspective view of the palm side of present invention, the protective glove with three finger stalls.

FIG. 1 depicts a front perspective view of the ornamental frame (10), FIG. 2 is an exploded view of the ornamental frame (10), and FIG. 1*a* is a cross sectional view of the ornamental frame (10). Ornamental frame (10) comprises a front frame and a back support plate (45).

The front frame (41) has a polygonal shape that includes a horizontal top member (70), a horizontal bottom member (65), a vertical left frame member (60) and vertical right frame member (55) securely attached together wherein an opened interior window is formed therein. In the illustrated embodiment the front frame (41) has a rectangular polygonal shape. The front frame (41) has an opening with a perimeter substantially equivalent to the perimeter of a conventional LP Album storage container. Materials used to make the front frame include wood, plastic, steel, or another suitable rigid material.

Finger notch (50) is carved near the midpoint within the bottom horizontal member (70). In the illustrated embodiment the finger notch (50) is a recessed curved half-circle. The finger notch (50) provides a means for removing an LP album from the front frame (10). Top and bottom guiding channels (35, 40) are respectively disposed along the inner peripheral surfaces of the top and bottom horizontal members (70, 65). The top and bottom guiding channels (35, 40) are used to insert the LP album into the inner portion of front frame (10). As depicted, the left and right vertical members (60, 55) do not have guiding channels to receive the opposing sides of an LP album.

The back support plate (45) has a perimeter and polygonal shape equivalent to the front frame (10). Back support plate (45) has a flat front side and flat back side that is defined by a horizontal top edge, a horizontal bottom edge, a vertical left edge and vertical right edge. The back support plate member (45) supports the LP album storage container while inserted into the ornamental frame (10). As shown, the top opposing corners of the upper edge of the top horizontal member tapers outwardly and downwardly toward the back support plate and top opposing corners of the upper edge of the back support plate tapers upwardly to adjoined with the opposing top corners thereby forming a top guiding channel therein. The bottom opposing corners of the lower edge of the lower opposing corners of the lower edge of the back support plate tapers downwardly adjoining with the lower opposing corners of the horizontal bottom member thereby forming of the bottom guiding channel therein. Additionally, the opposing vertical members do not have any guide members and are solid and continuous.

The hanging mechanism comprises top bar (25) and lower bar (30). As depicted top bar (25) and lower bar (30) are spaced apart in a parallel arrangement. The hanging mechanism is permanently attached near the central portion of the back side of the back support plate (45). As depicted in FIG.

1A top bar (25) and lower bar (30) can be permanently installed to the wall (15) using depicted fasteners (20). The hanging mechanism can be made of wood, plastic, metal, or another suitable material.

FIGS. 3, 4 and 5 illustrates an LP album (100) being inserted into the ornamental frame (10). Typically, the LP Album (100) has a front cover, a back cover, an unbound edge on the opposite side of a bound edge. The unbound edge is used to insert albums, photographs, cards, certificates, or other suitable paraphernalia.

FIGS. 3, 4, 4A, and 5 illustrates the operational functional features of the ornamental frame (10) in conjunction with a storage container of a LP Album (100). As depicted in FIGS. 3 and 5 the upper edge of storage container of the LP Album is inserted into the top guiding channel (35). As depicted in FIGS. 4 and 4A, as the storage container of the album is placed within the ornamental frame it is released into the bottom guiding channel (40). To remove the storage container from the ornamental frame (10), a finger is placed into the finger notch (5) while simultaneously pushing upward the storage container from the bottom guiding channel (40) into the top guiding channel (35). Then the storage container can be removed from the ornamental frame.

Figure 6:
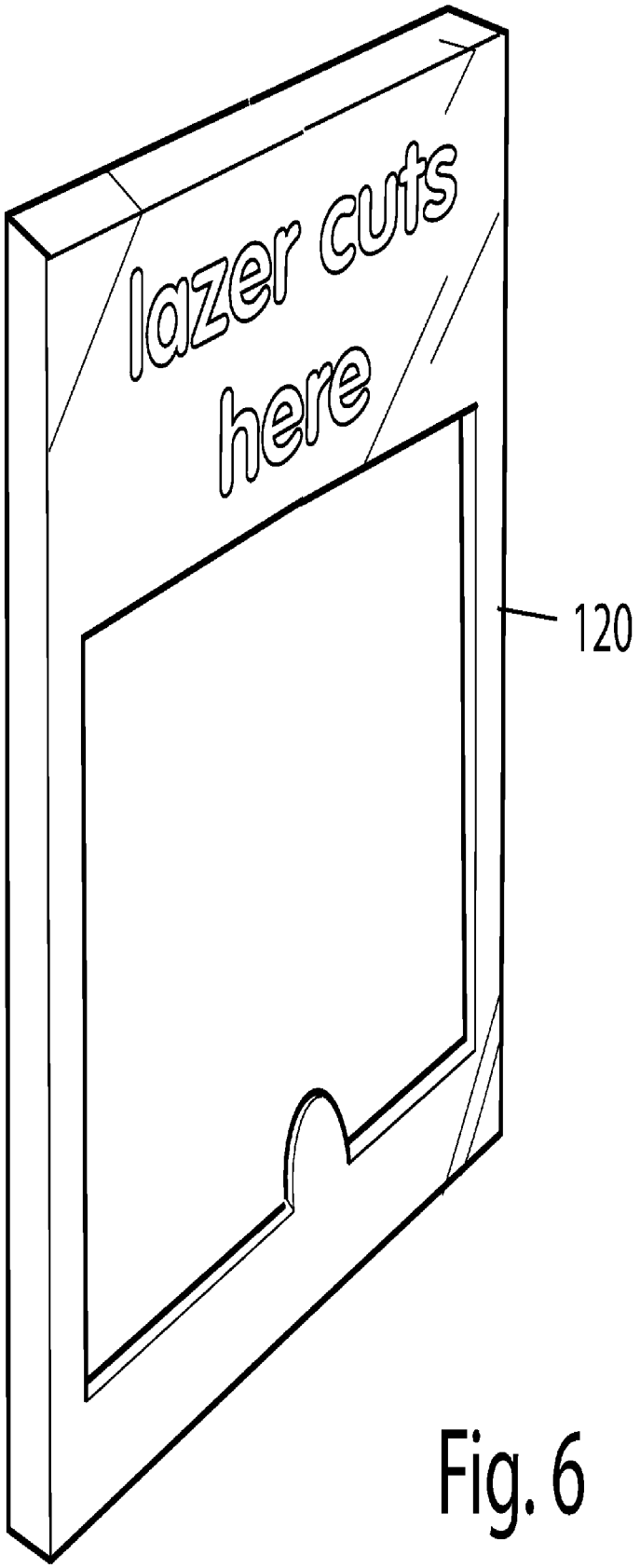
FIG. 6 is a perspective view showing the decorative sleeve of the ornamental frame
Figure 7:
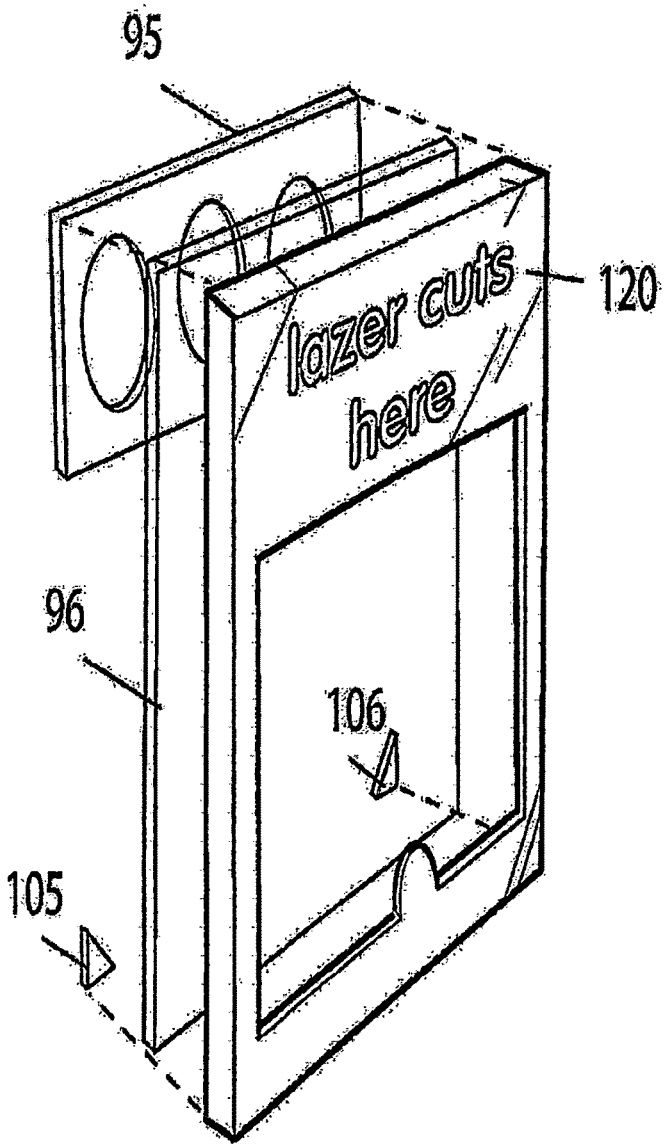
FIG. 7 is an exploded view of the decorative sleeve.
Figure 8:
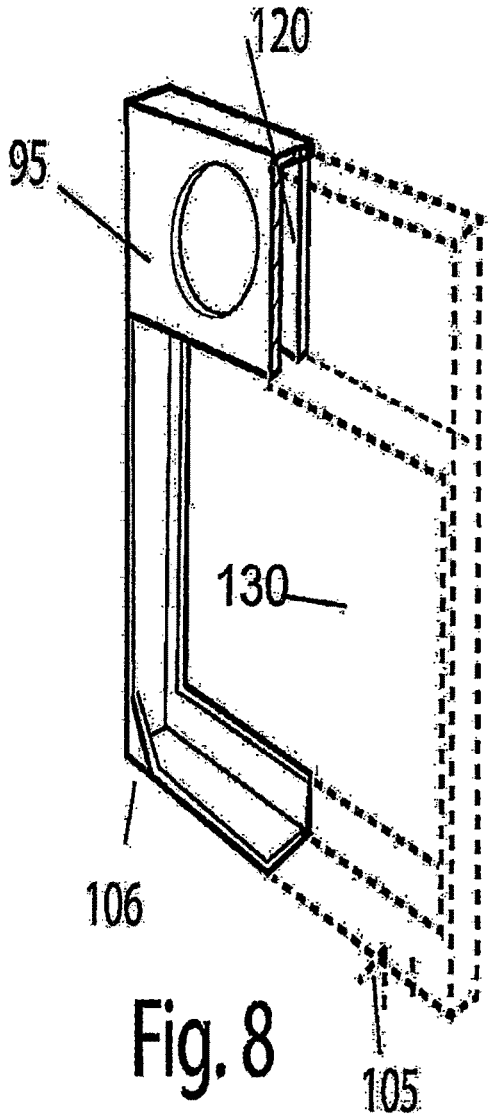
FIG. 8 is a cut away view of the decorative sleeve.

FIG. 6 illustrates ornamental sleeve (120) that encapsulates the ornamental frame and is defined by a front face and a rear face. The front face includes a top portion disposed directly above a bottom portion. The bottom portion forms a front display window and the top portion forms an ensign display. The front display window includes an opening having a perimeter substantially equivalent to the display portion of the front frame of the ornamental frame. As depicted, display window comprises a top horizontal edge, bottom horizontal edge, a left vertical edge and right vertical edge. A bottom ledge is perpendicularly attached to the bottom horizontal edge of the front display window (130) and protrudes outwardly in a horizontal orientation away from the front display window. The bottom ledge is a flat panel for receiving the bottom horizontal member of the ornamental frame while encapsulated by the ornamental frame.

Figure 9:
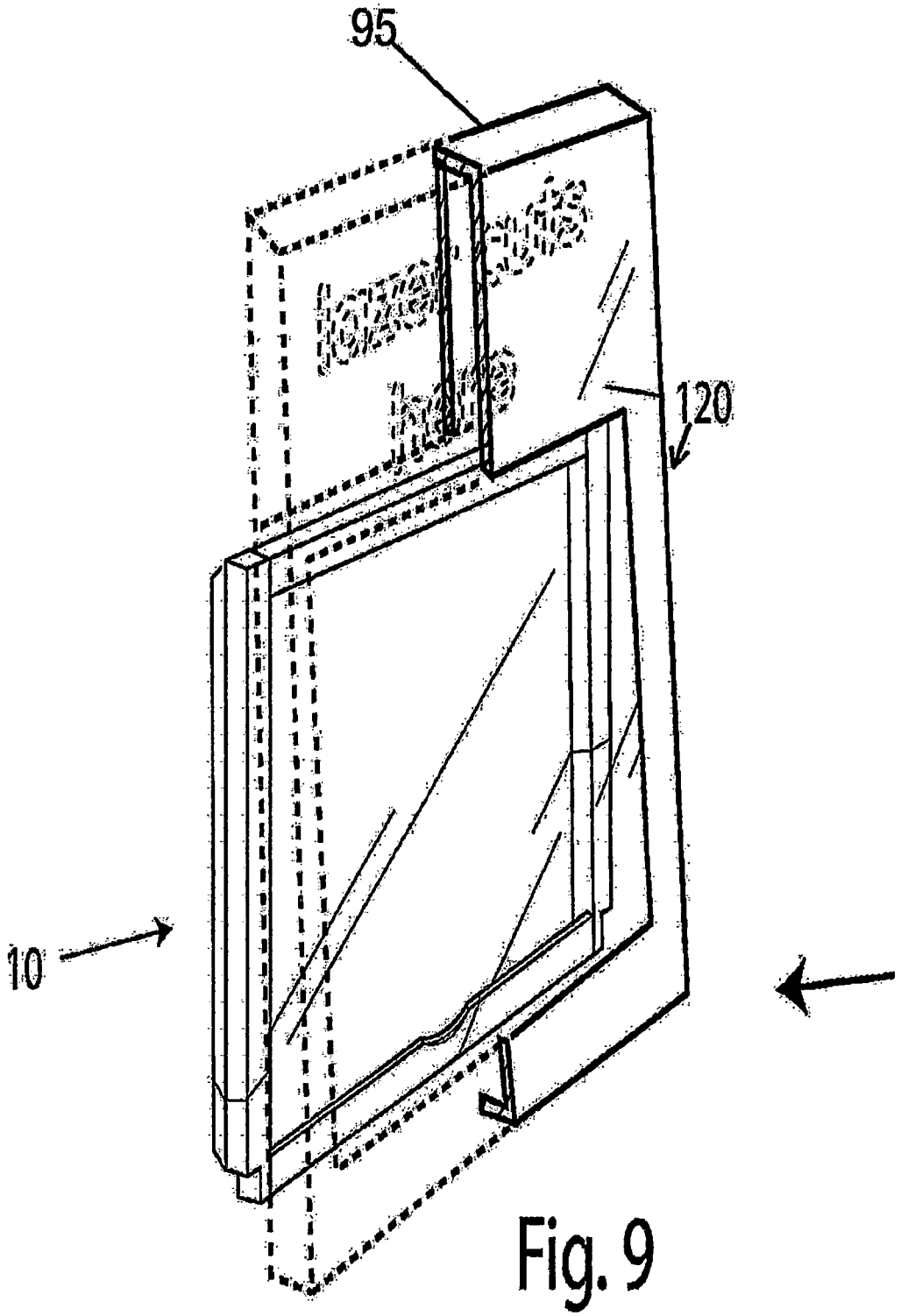
FIG. 9 is perspective view showing the placement of the sleeve on the ornamental frame.
Figure 10A:
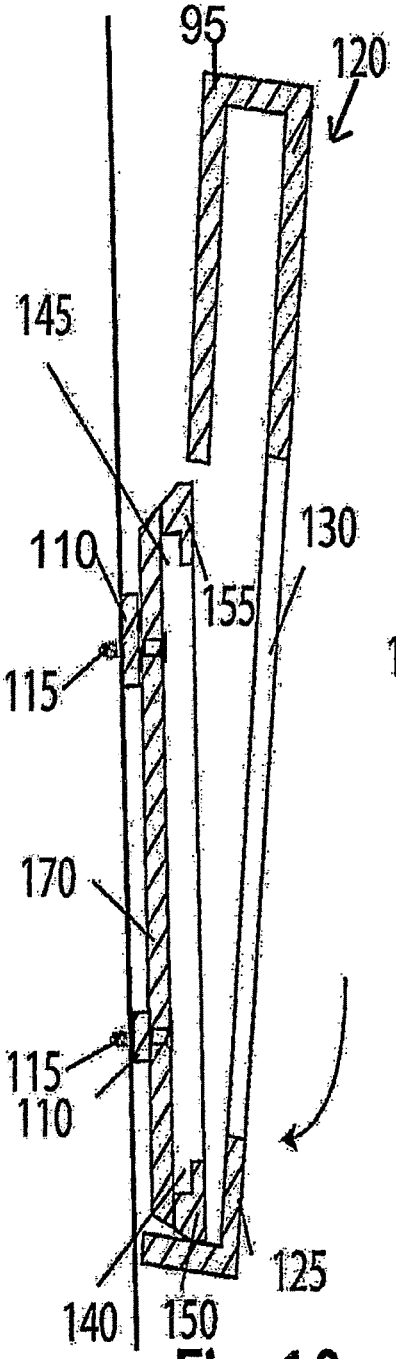
FIG. 10A is a cross-sectional view of the sleeve placed on the bottom of the ornamental frame.
Figure 10B:
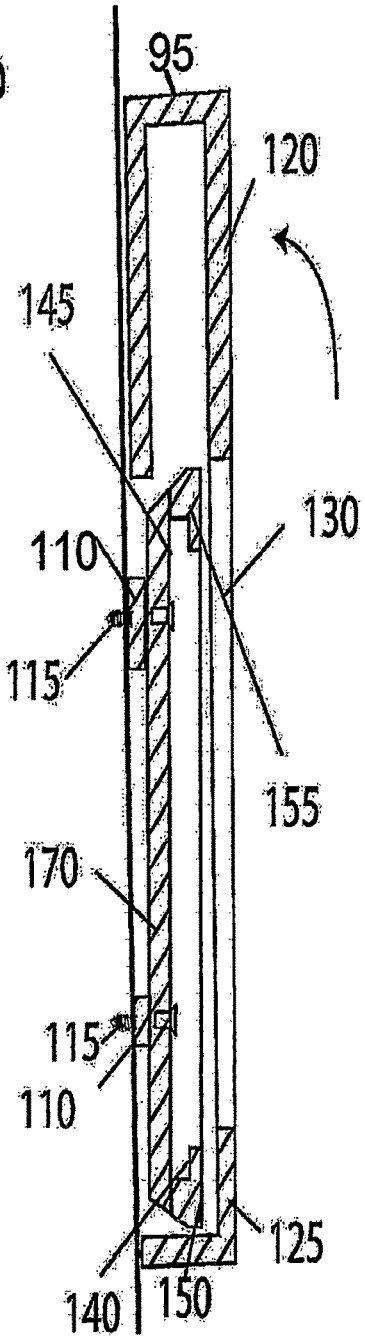
FIG. 10B is a cross-sectional view of the sleeve placed on the top of the ornamental frame.
Figure 10C:
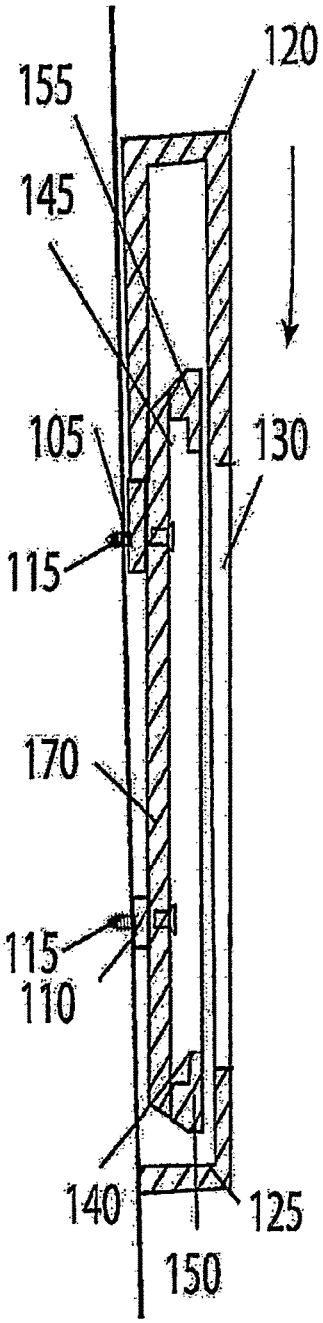
FIG. 10C is a cross-sectional view of the sleeve placed on the back of the ornamental frame.
Figure 11:
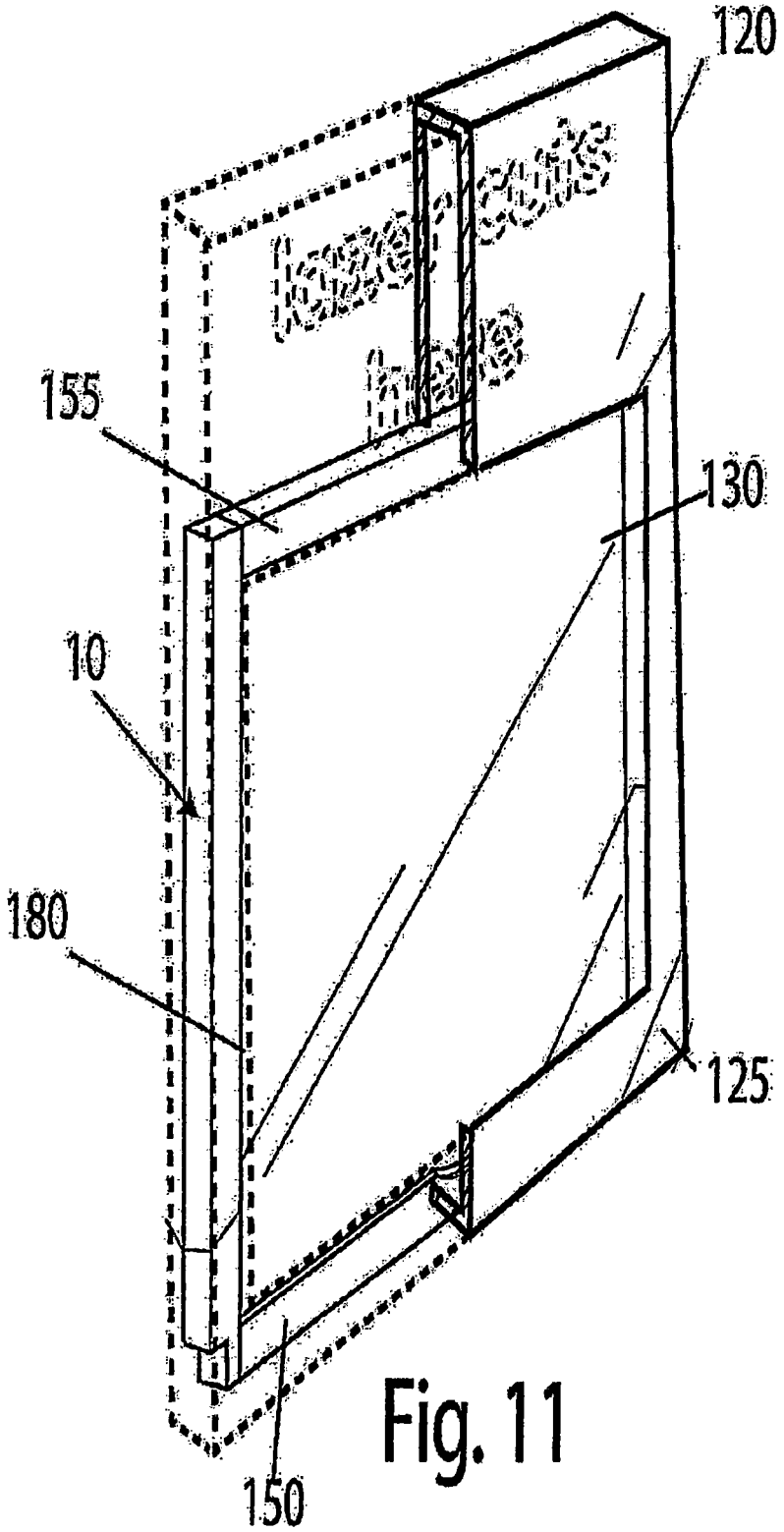
FIG. 11 is a perspective view of the sleeve on the frame.

Ensign display (95) forms a compartment for encapsulating the top portion of the ornamental frame. Ensign display can have a width and length of at least two inches and is integrally formed directly above the display window. The compartment of the ensign display is defined by a back panel extending downwardly in a vertical orientation to a distance aligned directly above the front display window. The back panel further comprises one or more apertures that can be aligned in a horizontal orientation. In use, the ornamental sleeve (120) is slid over the ornamental frame wherein the bottom edge of the ornamental frame seats upon the bottom ledge. FIG. 9 is a perspective view depicting sleeve (120) being placed upon ornamental frame (10). Back plate (96) of ornamental frame (10) is shown. Triangular fasteners (105, 106) secure ornamental frame (10) within sleeve (120). FIGS. 10*a*, 10*b*, and 10*c* illustrates ornamental frame (10) being inserted into sleeve (120). Ornamental frame (10) has hanging mechanism comprising top and bottom parallel member (110) bolted space apart to back plate (170). FIG. 10*a* illustrated the initial entry of ornamental frame (10) into sleeve (120) by placing upon bottom (125) as depicted top horizontal member (150) is adjoined to back plate (170) forming top guide (145). As further illustrated, bottom horizontal member (155) is adjoined to back plate (170) forming bottom guide (150).

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. An ornamental frame in combination with an ornamental display comprising:

a front frame and a back support plate;

the front frame having a polygonal shape defined by a horizontal top member, a horizontal bottom member, a vertical left frame member and vertical right frame member securely attached together wherein an opened interior window is formed therein; the back support plate having a perimeter with a shape equivalent to the front frame;

the back support plate having a flat front side and flat back side that is defined by a horizontal top edge, a horizontal bottom edge, a vertical left edge and vertical right edge; a top guiding channel formed adjacent to the between the adjoined horizontal top member and the horizontal top edge;

a lower guiding channel formed adjacent to the horizontal bottom member and the horizontal bottom edge;

wherein the insertion of an upper edge of the ornamental display fits within the top guiding channel and a lower edge of the ornamental display being inserted into the lower guiding channel a sleeve with an internal opening that encapsulates the ornamental frame; the sleeve having a front face and a rear face encapsulating the internal opening;

the front face defined by a top portion disposed directly above a bottom portion;

the bottom portion forms a front display window and the top portion forms an ensign display;

the front display window includes an opening having a perimeter substantially equivalent to the opening of the front frame of the ornamental frame; and the display window comprises a top horizontal edge, bottom horizontal edge, a left vertical edge and right vertical edge.

2. The frame of claim 1 wherein the perimeter of the back support plate member being equivalent to a perimeter LP album storage container.

3. The frame of claim 2 wherein the ornamental display is the LP Album storage container.

4. The frame of claim 2 wherein the opened interior window of the front frame have a perimeter substantially equivalent to the perimeter the LP Album storage container.

5. The frame of claim 1 wherein the front frame has a rectangular polygonal shape.

6. The frame of claim 1 wherein the front frame is made of a material selected om the group consisting of wood, plastic, steel or rigid material.

7. The frame of claim 1 wherein the horizontal bottom member further comprises a finger notch formed by a recessed curved half-circle along an upper edge of the bottom horizontal member therein.

8. The frame of claim 1 further comprising a hanging mechanism formed a spaced apart top bar and a lower bar in a parallel arrangement secured to the back side of the back support plate.

9. The frame of claim 8 wherein the hanging mechanism is made of a material selected from the group consisting of wood, plastic, and metal.

10. The frame of claim 1 further comprising a bottom ledge that is perpendicularly attached to the bottom horizontal edge of the front display window and protrudes outwardly in a horizontal orientation away from the front display window; and the bottom ledge is a flat panel for receiving the bottom horizontal member of the ornamental frame while encapsulated by the sleeve.

11. The frame of claim 1 wherein the ensign display forms a compartment for encapsulating a top portion of the ornamental frame.

12. The frame of claim 11 wherein the ensign display can have a width and a length of at least two inches and is integrally formed directly above the display window; and the compartment of the ensign display is defined by a back panel extending downwardly.

13. The frame of claim 12 wherein the back panel further comprises one or more apertures that can be aligned in a horizontal orientation.

* * * * *